United States Patent [19]

Garrett

[11] 4,217,966

[45] Aug. 19, 1980

[54] JUNK BASKET, BIT AND REAMER STABILIZER

[75] Inventor: William R. Garrett, Houston, Tex.

[73] Assignee: Smith International, Inc., Newport Beach, Calif.

[21] Appl. No.: 872,729

[22] Filed: Jan. 26, 1978

[51] Int. Cl.[2] ..... E21B 27/00

[52] U.S. Cl. ..... 175/308; 166/99; 175/348

[58] Field of Search ..... 175/308, 325, 343, 408, 175/398–400, 348; 166/99, 162, 202; 285/333, 334, 422, DIG. 17

[56] References Cited

U.S. PATENT DOCUMENTS

| | | | |
|---|---|---|---|
| 1,487,061 | 3/1924 | Heflin | 166/99 |
| 2,801,079 | 7/1957 | Gress | 166/162 X |
| 3,079,181 | 2/1963 | Van der Wissel | 285/333 |
| 3,080,179 | 3/1963 | Huntsinger | 285/422 X |
| 3,659,882 | 5/1972 | Souresny | 285/422 X |
| 3,680,646 | 8/1972 | Hughes et al. | 175/325 X |
| 3,907,047 | 9/1975 | Thompson et al. | 175/312 |
| 3,933,210 | 1/1976 | Skidmore | 285/333 X |
| 4,076,436 | 2/1978 | Slator et al. | 285/333 X |
| 4,082,373 | 4/1978 | Kellner | 175/325 X |
| 4,111,262 | 9/1978 | Duncan | 175/308 X |

FOREIGN PATENT DOCUMENTS

| | | | |
|---|---|---|---|
| 913279 | 12/1962 | United Kingdom | 285/DIG. 17 |

*Primary Examiner*—Ernest R. Purser
*Assistant Examiner*—Richard E. Favreau
*Attorney, Agent, or Firm*—Murray Robinson; Ned L. Conley; David Alan Rose

[57] ABSTRACT

A metal cup with an apertured bottom provides a junk basket. The cup is spindled on the pin of a drill bit, e.g. a tungsten carbide insert roller cone bit, the bottom edge being releasably clamped between the pin shoulder and the shoulder formed by the mouth of the box on the member forming the lower end of the drill stem, e.g. a roller reamer. The connection between the pin and box and cup form a rotary shouldered connection, the pin shoulder and/or box mouth being cut back providing a longer pin neck or shallower box to accommodate the cup. Every time the bit is removed from the stem, the interiorly upwardly flaring cup is automatically dumped. In a modification, especially for small diameter holes, in order to provide space for junk to move both up outside the cup and down into the cup, the box on the adjacent drill stem member can be fluted, e.g. with arcuate vertical section milled slots extending from above to below the rim of the cup to provide entrance for junk, so maximum exterior annulus space is left for upflow of junk; alternatively the cup aperture can be eccentric, so the space around the outside of the cup is large at one sector and the space around the box inside the cup is large at the opposite sector.

11 Claims, 8 Drawing Figures

$w$ = 5/16" FOR 4 1/2" BIT TO 1/2" FOR 8 3/4" BIT
$d$ ≈ BIT PIN LENGTH TO 2X BIT PIN LENGTH
$d \approx 5(h)$ TO $50(h)$
$h$ = 1/4" TO 1/2"
$p$ = BIT PIN THREAD PITCH EQUALS 3 TO 4 TURNS PER INCH
$h$ ≈ ONE THREAD TURN

JUNK BASKET, BIT AND REAMER STABILIZER

BACKGROUND OF THE INVENTION

This invention pertains to earth boring by the rotary system of drilling, and more particularly to a junk basket used near the lower end of the drill string to remove from the drilling fluid stream any heavy solids, such as broken tunsten carbide inserted teeth of roller cone drill bits, which might not easily be carried out of the well bore with the drilling fluid and which might fall back in the bottom of the hole and damage the drill bit or otherwise interfere with continued drilling.

It is already known to provide drill bits with integral junk baskets, as shown by U.S. Pat. No. 1,895,610—Del Homme. This structure has the disadvantage that the junk basket must be thrown away with the bit when the latter wears out.

It is also known to provide a basket on a special sub to be inserted in the drill string between the bit and the rest of the drill thereabove, as shown by page 3646 of the 1948 edition of the Composite Catalog of Oil Field and Pipe Line Equipment. This structure has the disadvantage of needing to be unscrewed from the rest of the drill string thereabove in order to be dumped, and since the basket is integral with the flow pipe therethrough, junk wedged therein must be dug out. In addition, the extra cost of the sub is objectionable.

A sub with a screwed-on basket is disclosed by U.S. Pat. No. 3,102,600—Jackson. To dump this basket it appears to be necessary to unscrew the sub from the pin on the lower end of the drill pipe, and the junk is then apt to fall into the box in the upper end of the sub, necessitating cleaning the box before reconnecting the sub to the pin. Alternatively, if the basket is unscrewed from the sub the junk will fall around the threads on the exterior of the sub; also, junk wedged between the basket and pipe may prevent the basket from being elevated for dumping or even from being unscrewed.*

*See also U.S. Pat. No. 2,894,725—Baker (ribbed sub)

Junk baskets have also been associated with other drill string equipment than drill bits, e.g. as shown in U.S. Pat. Nos.:

1,656,526—Lincoln (between drill collar and pipe)
1,753,339—Hencken (down hole motor)
2,376,974—Miller (down hole motor)
2,670,800—Stohn (fishing tool)
2,670,930—Farrar (jar)
2,675,879—Middleton et al (fishing tool)
2,819,038—Eckel (down hole motor)
3,118,510—Kanady et al (wire line basket)
3,378,089—Marsh (fishing tool)
3,814,180—Oliver (fishing tool)
3,856,355—Grable (down hole motor)

but in no case is the basket readily removable for dumping. The Hencken basket is connected to the drill string and is provided with a valve controlled opening in its bottom. The Marsh basket is welded to the top sub and for dumping, it must be inverted, after the sub is disconnected from the drill string. Similarly, in none of the others of these constructions is the basket adapted for easy removal nor is it automatically freed for dumping whenever the bit is changed any more than in the aforementioned Del Homme, Reed, and Jackson constructions. The basket is either integral or screwed on or welded on.

It is known to clamp the flange of an ancillary drill stem member between the pin shoulder and box mouth of a tool joint connection, as shown in U.S. Pat. Nos.:

1,518,960—Bowser (sucker rod centralizer)
2,167,194—Anderson (drill stem stabilizer)
2,546,295—Boice (tool joint wear collar)
3,343,890—Homer (casing protector)
3,978,933—Olson & McNeil (drill stem stabilizer)

but in none of the foregoing is there shown a junk basket or the like which is automatically freed for dumping whenever the drill bit is disconnected.

A cuplike member with a central aperture in the bottom clamped between shoulders on other screwed together members is shown in each of U.S. Pat. Nos.:

1,464,927—Field (drinking fountain)
1,487,061—Heflin (pump cylinder protector)

but in neither case is junk generated below the cup the primary material to be caught, for in neither case is there a drill bit below the cup. In neither case is there provision for fluid circulation down through the interior of the cup, but sealed off therefrom, and thence back up around the outer periphery of the cup. In neither case is frequent disassembly and dumping of the cup contemplated. In neither case is the cup to be rotated during use.

It is apparent from the above discussion that the prior art has not taught a construction in which there is provided a junk basket that is readily removable for dumping and which is automatically freed for dumping whenever the drill bit is changed.

SUMMARY OF THE INVENTION

According to the invention a metal cup with an apertured bottom provides a junk basket. The cup is spindled on the pin of a drill bit, e.g. a tungsten carbide insert roller cone bit, the bottom edge of the cup being releasably clamped between the pin shoulder and the shoulder formed by the mouth of the box on the member forming the lower end of the drill stem, e.g. a roller reamer. The connection between the pin and box and cup form a rotary shouldered connection, the pin shoulder and/or box mouth being cut back providing a longer pin neck or shallower box to accommodate the cup. Every time the bit is removed from the stem, the interiorly upwardly flaring cup is automatically dumped. In a modification, especially for small diameter holes, in order to provide space for junk to move both up outside the cup and down into the cup, the box on the adjacent drill stem member can be fluted, e.g. with arcuate vertical section milled slots extending from above to below the rim of the cup to provide entrance for junk, so maximum exterior annulus space is left for upflow of junk; alternatively the cup aperture can be eccentric, so the space around the outside of the cup is large at one sector and the space around the box inside the cup is large at the opposite sector.

An advantage of a junk basket made in accordance with the invention lies in the fact that whenever the drill string is pulled and the bit replaced, the basket automatically is disconnected, and when it comes loose it is thereby automatically dumped or emptied, and if anything is stuck in it cleaning is easy. No extra time is required to make up and break out connections associated solely with the junk basket, either for assembling, dumping or replacing the junk basket. The basket is placed immediately above the bit, which is the most advantageous position for catching dense junk such as carbide inserts broken off from the bit. No extra connections or attachments are required. There is no interference with a reamer or stabilizer which can be placed immediately above the bit.

Other advantages and objects of the invention will become apparent from the following detailed description of a preferred embodiment and several modifications thereof.

BRIEF DESCRIPTION OF THE DRAWINGS

Referring now to the accompanying drawings.

DETAILED DESCRIPTION OF PREFERRED EMBODIMENTS

Figure 1:
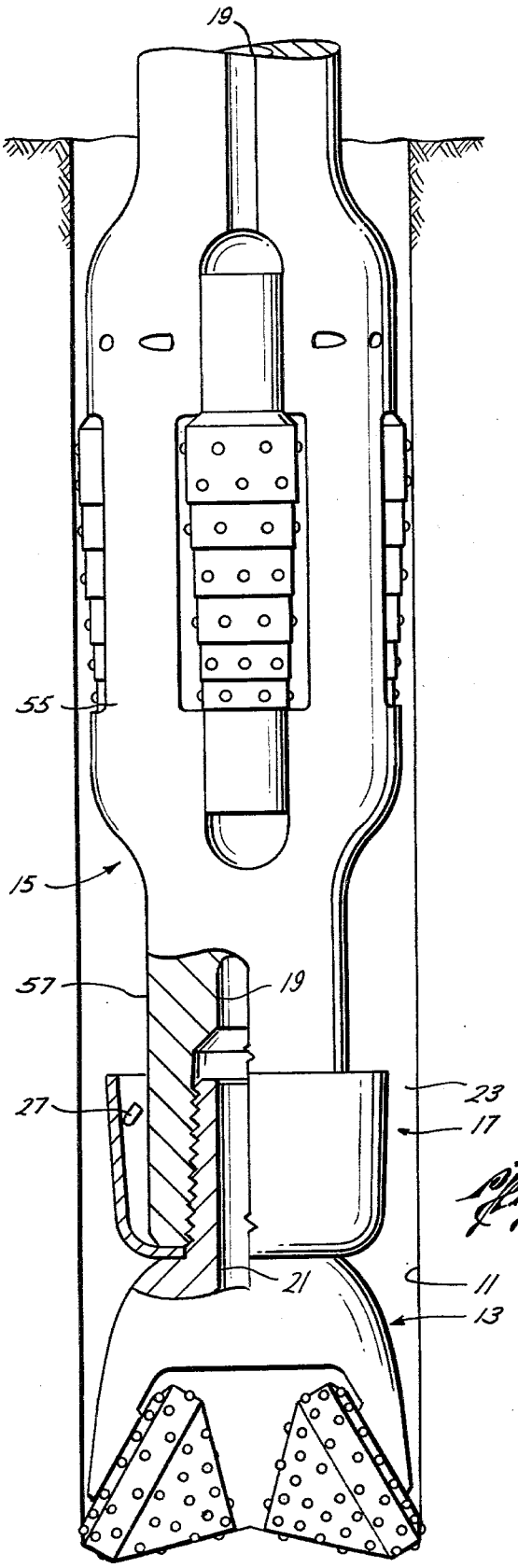
FIG. 1 is an elevation, partly in section illustrating a preferred embodiment of the invention, including bit, basket and reamer.

Referring now to FIG. 1 there is shown a well bore 11 within which is disposed a threecone rock bit 13. Screwed to the top of bit 13 is the lowermost element of a rotary drilling stem, namely a roller reamer 15. Clamped between the bit and reamer is a junk basket 17. There is a fluid passage 19 through the reamer which connects with a fluid passage 21 through the drill bit. The outer periphery of the junk basket is of smaller diameter than that of the inner periphery of the well bore, leaving an annular fluid passage 23 therebetween. In use, drilling fluid, e.g. mud, flows downwardly through fluid passages 19 and 21 to the bottom 25 of the well bore, thence back up the well bore through annulus 23 and on up to the top of the well bore. As the drilling fluid passes the junk basket, its velocity drops due to the increased area perpendicular to the flow path, and dense junk drops into the basket. For example, there is shown a tungsten carbide insert 27 trapped in the basket.

During drilling, the reamer 15 not only maintains the well bore at full gage but centralizes the bit and junk basket. For a further description of a suitable roller reamer, which may be modified in accordance with the invention in the manner hereinafter described, see U.S. Pat. No.: 3,306,381—Garrett et al.

Figure 2:
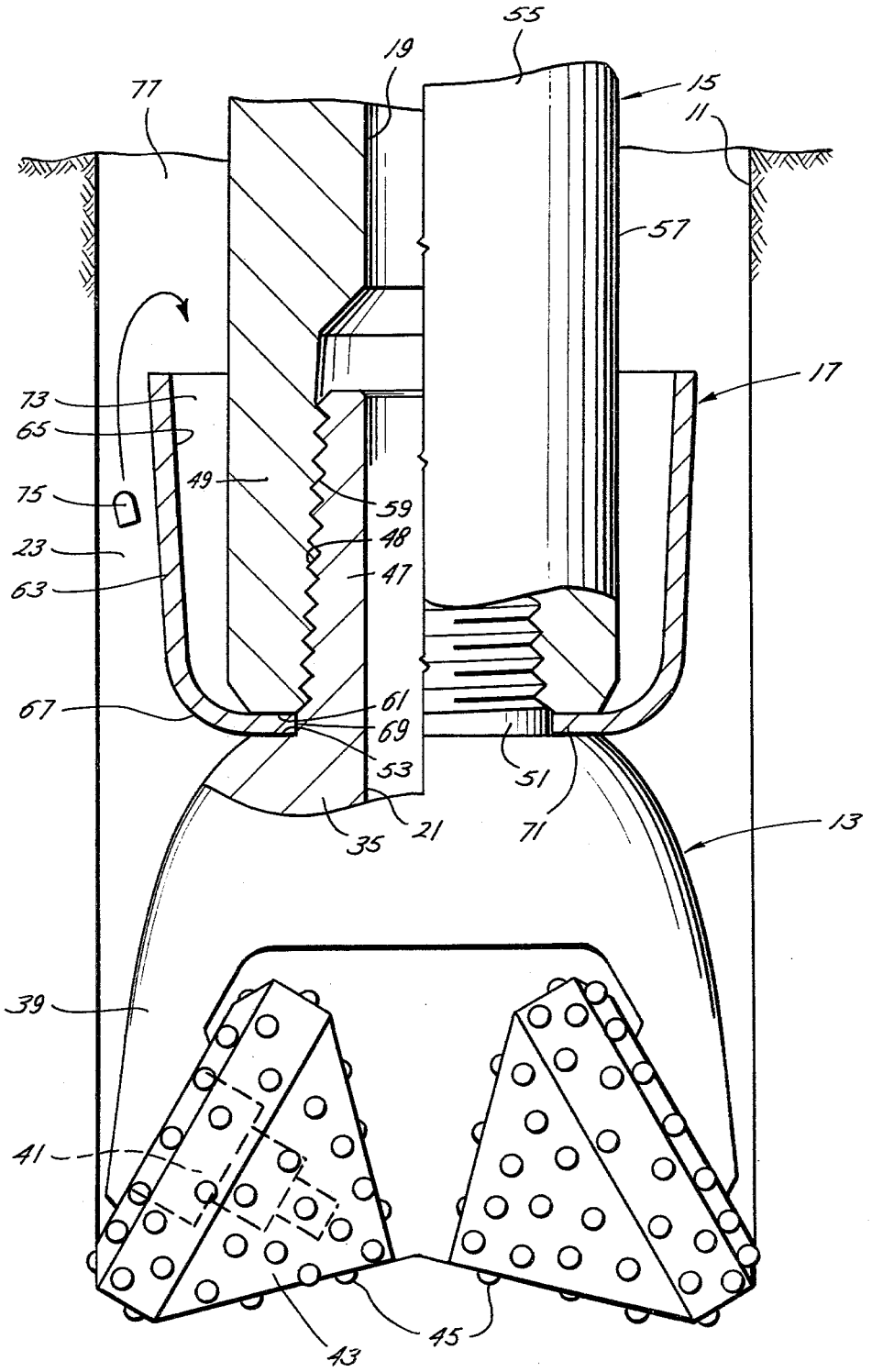
FIG. 2 is a view to a larger scale of the lower portion of the apparatus shown in FIG. 1.

Referring now to FIG. 2, drill bit 13 includes a body 35 through which extends fluid passage 21. The body is provided with three legs 39. Each leg has a stub shaft 41 on which is rotatably mounted a conical cutter or cone 43. Each cone is provided with a plurality of inserted tungsten carbide teeth 45. For a further description of a generally suitable drill bit see the "F" bit on page 4576 of the Composite Catalog of Oil Field Equipment and Services, 1974–1975, edition. Such a bit can be modified as hereinafter described for use in the invention, or can be used without modification in certain forms of the invention.

At the upper part of the bit body 35 there is a pin 47 having an external tapered thread 48. At the base of the pin is an unthreaded cylindrical portion or root 51. Adjacent root 51 is a flat shoulder 53 extending in a plane perpendicular to the axis of pin 47.

Pin 47 is screwed into a box 49 formed at the lower end of reamer 15. The reamer includes a tubular mandrel or body 55. The lower end of the mandrel 55 is of reduced diameter, forming a neck 57. Box 49 is formed at the lower end of neck 57.

Box 49 has an internal tapered thread 59 correlative to the thread 48 on the drill bit pin. The mouth of the box is flat, forming a shoulder 61 which lies in a plane perpendicular to the axis of the box.

Basket 17 comprises a cup having a side wall 63 whose inner periphery 65 flares upwardly. The bottom 67 of the cup is apertured at 69, leaving a cylindrical hole which fits snugly around root 51 of the drill bit pin 47. The bottom edge 71 of the cup has flat upper and lower surfaces disposed in planes perpendicular to the axis of the pin 47 and box 49. The thickness of bottom edge 71 is such that when the pin and box are almost fully made up (thread pitch cones nearly coincident) the bottom edge 71 is clamped between shoulders 53 and 61. As the pin and box are fully made up the edge 71 is placed in compression and root 51 is put in tension.

Edge 71 is made of metal having a strength and hardness sufficient to prevent the box being over made up on the pin, for over make up would damage the threads, i.e. a metal having a hardness in the range of 250–300 Brinell and a tensile strength of at least 80,000 pounds per square inch. For example, edge 71 may have a strength and hardness equal to that of pin 47 and box 49 at shoulders 53 and box 61. This will prevent edge 71 from merely cutting or mashing, which might occur if its yield point were exceeded locally or overall when the pin and box are made up. The elastic modulus of the metal of edge 71 will be about the same as that of the pin and box since these parts and the basket should all be made of steel. The entire cup may be made of the same material as the edge and have a tensile strength in the range of 100,000 to 150,000 pounds per square inch. The thickness of edge 71 should be sufficient that there will be adequate strain under usual make up torques for rotary shouldered connections. For a further disclosure of such a connection see U.S. Pat. No.: 3,754,609—Garrett. For a disclosure of suitable make up torque see "Rotary Shouldered Connections" by Drilco, pages 7 and 8, 1972 edition.

When basket 17 is assembled with bit 13 and reamer 15, the inner periphery 65 of the side of basket 17 is spaced from the outer periphery of box 47, forming an annular pocket 73. Junk, such as broken tooth or insert 75 from the drill bit, can travel up through annulus 23 outside of the basket and then upon reaching the larger annulus space 77 around the top of neck 57, will slow down and fall inwardly into the pocket, following the path indicated by the arrow.

After drilling has proceeded long enough that bit 13 is worn out and needs to be changed, the drill string will be pulled out of the well bore 11. When bit 13 is unscrewed from stabilizer 15 so that the bit can be replaced, junk basket 17 will automatically be freed, and when the basket is lifted off of the bit pin the hole 69 therethrough will be open and the junk in the basket will fall out. Since the inner wall of the cup forming the basket is upwardly flaring, there will be no interior pockets in which junk can come to rest and fail to fall out. Since the bit pin 47 is downwardly flaring, there will be no tendency for junk to be wedged into the basket in a manner to prevent easy removal of the basket from the bit.

Figure 3:
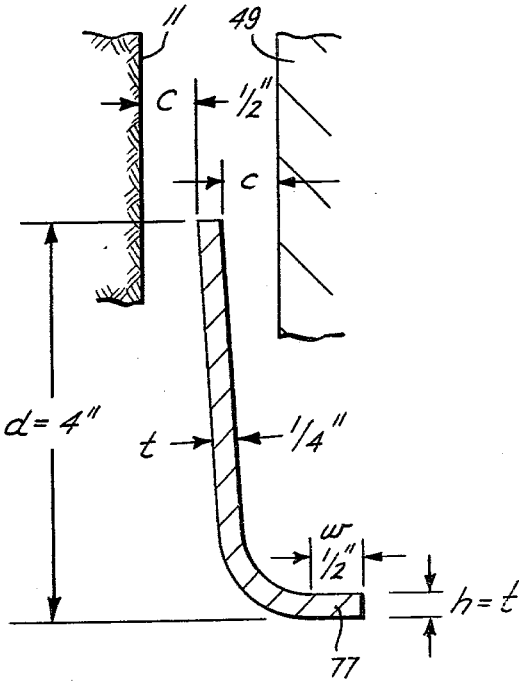
FIG. 3 is a fragmentary view of the basket, showing preferred dimensions and configuration.

Referring now to FIG. 3, there is shown a fragmentary sectional view of the junk basket cup illustrating some of the dimensions and proportions for a typical cup for use in an $8\frac{3}{4}$ inch well bore.

The thickness t of the side wall is $\frac{1}{4}$ inch and the depth is 4 inches. The flat inner edge 77 of the cup to be captured between bit and stabilizer is an annular ring of radial extent or width w equal to $\frac{1}{2}$ inch.

The flange thickness or height is equal to or greater than t, e.g. $\frac{1}{4}$ inch to $\frac{1}{2}$ inch. The height h of the flange preferably spans in the range of one-half to two turns, preferably about one turn, of the thread on the bit pin, the pin thread pitch being about 4 to 5 turns per inch for a typical tool joint thread.

The diameter of the aperture 69 of a typical cup may range from four to ten inches.

The bit pin height is about 3 to 5 inches. The depth d of the cup may be from about the same extent as the length of the drill bit pin up to about twice that length and, preferably, it is equal to the pin height. Otherwise expressed, the depth of the cup is from about 5 to 50 times the edge height h. For example d may range from three to ten inches.

The width w of edge 77 may range down to about 5/16 inch for a $5\frac{3}{4}$ inch well bore, as compared to $\frac{1}{2}$ inch for an $8\frac{3}{4}$ inch bore, up to $\frac{7}{8}$ inch for $17\frac{1}{2}$ inch well bore. In this regard it should be noted that the radial clearance c between the maximum diameter outer periphery of the cup (which is at its upper edge) and the inner periphery of the well bore is about $\frac{1}{2}$ inch, which is also the radial clearance between the inner periphery of the cup at its upper edge and the outer periphery of the stabilizer neck 57.

Figure 5:
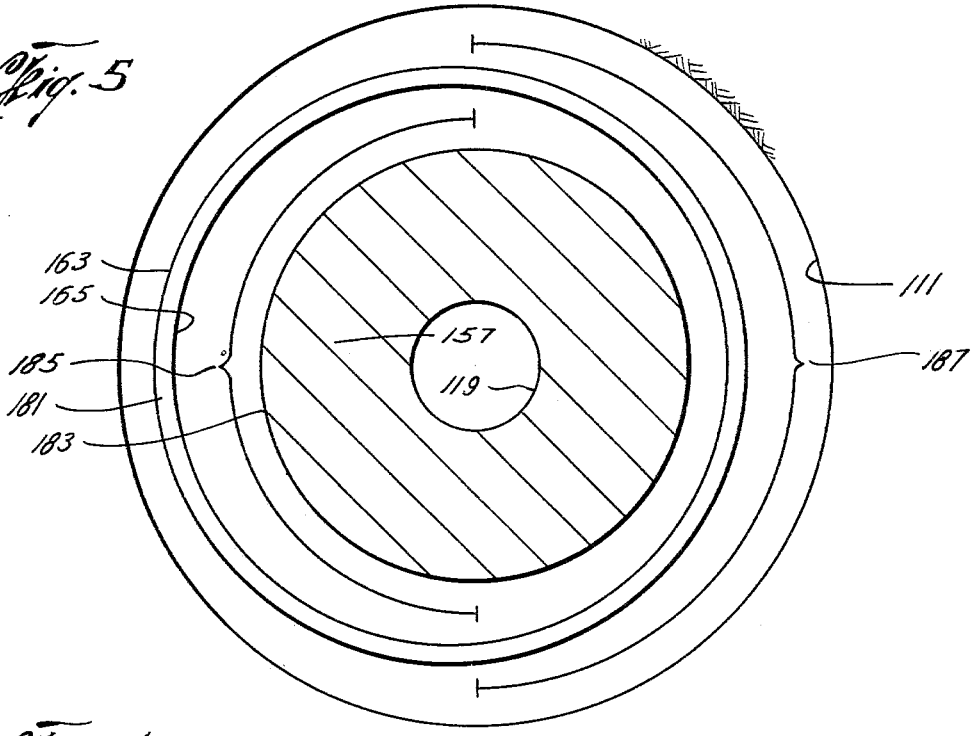
FIGS. 5 and 7 are top views thereof.
Figure 4:
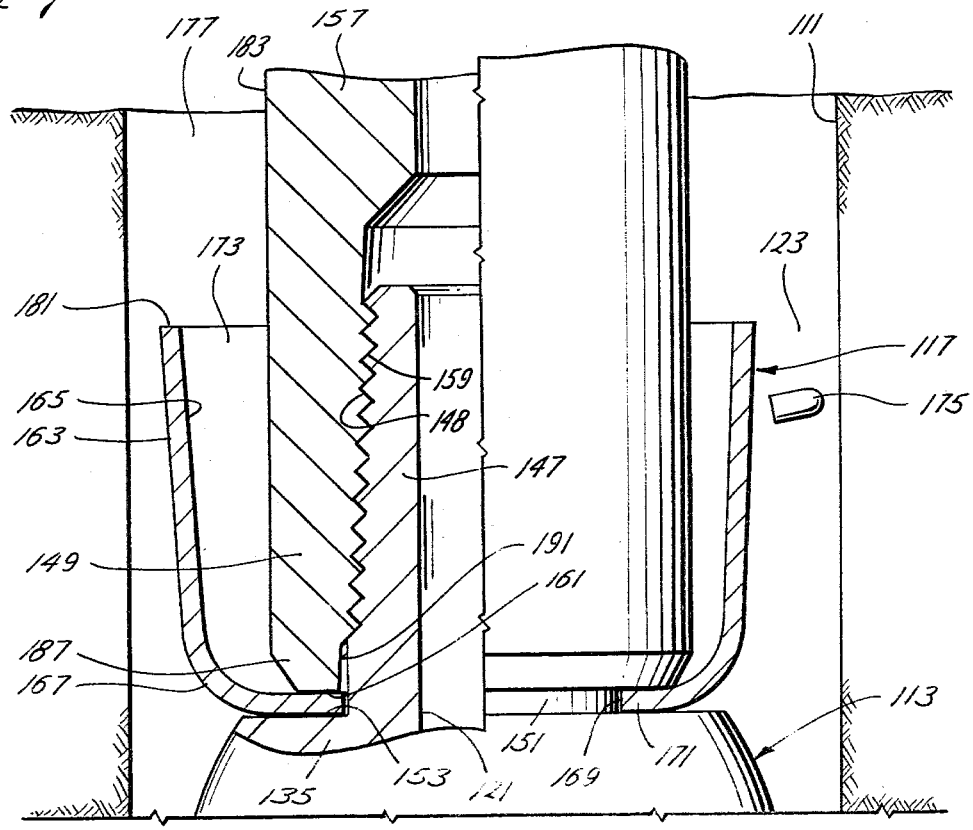
FIGS. 4 and 6 are views similar to FIG. 2 showing modifications.

Referring now to FIGS. 4 and 5 there is shown a modification of the above described embodiment. In the FIGS. 4 and 5 embodiment the construction is the same as in the FIG. 2 embodiment except as will now be pointed out. Corresponding parts are given like numbers plus one hundred. In this embodiment the side wall 163 of the cup forming the junk basket 117 is laterally displaced relative to the axis of the opening 169 through the bottom edge 171 of the cup. This results in the upper rim 181 of the cup being eccentric to the outer periphery 183 of stabilizer neck 157. As a consequence, the pocket 173 is of larger horizontal or radial extent at one side, forming a junk receiving sector 185, and at the other side is of smaller radial or horizontal extent, forming a sector 187 for external upflow of junk in the annulus 123 between the side of the junk basket cup and the bore hole 111. The horizontal extent of the annulus 123 outside basket sector 187 is large enough so that large junk can flow therein. Large junk will flow upwardly outside the basket adjacent the smaller radius sector thereof, swirl circumferentially around the stabilizer neck, and drop into the larger radius sector of the basket. This construction is well adapted for small diameter holes since it allows plenty of room for upward travel of large pieces of junk and still provides ample space to receive same.

FIG. 4 also illustrates a further modification of the FIG. 2 construction in that the unthreaded cylindrical portion or root 151 of the drill bit pin 147 is longer, the shoulder 153 of the bit having been cut back as compared to a standard bit pin. This leaves room for the inner edge 171 of the bottom part of the junk basket cup without the necessity for cutting back the shoulder 161 at the mouth 187 of the stabilizer box. In this construction there is also an unthreaded area 191 at the mouth of the box in which strain energy is stored during make up of the rotary shouldered connection.

Figure 7:
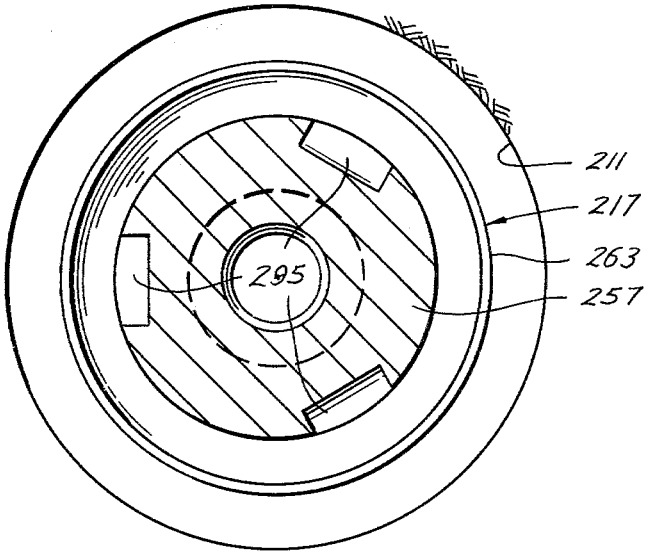
Figure 6:
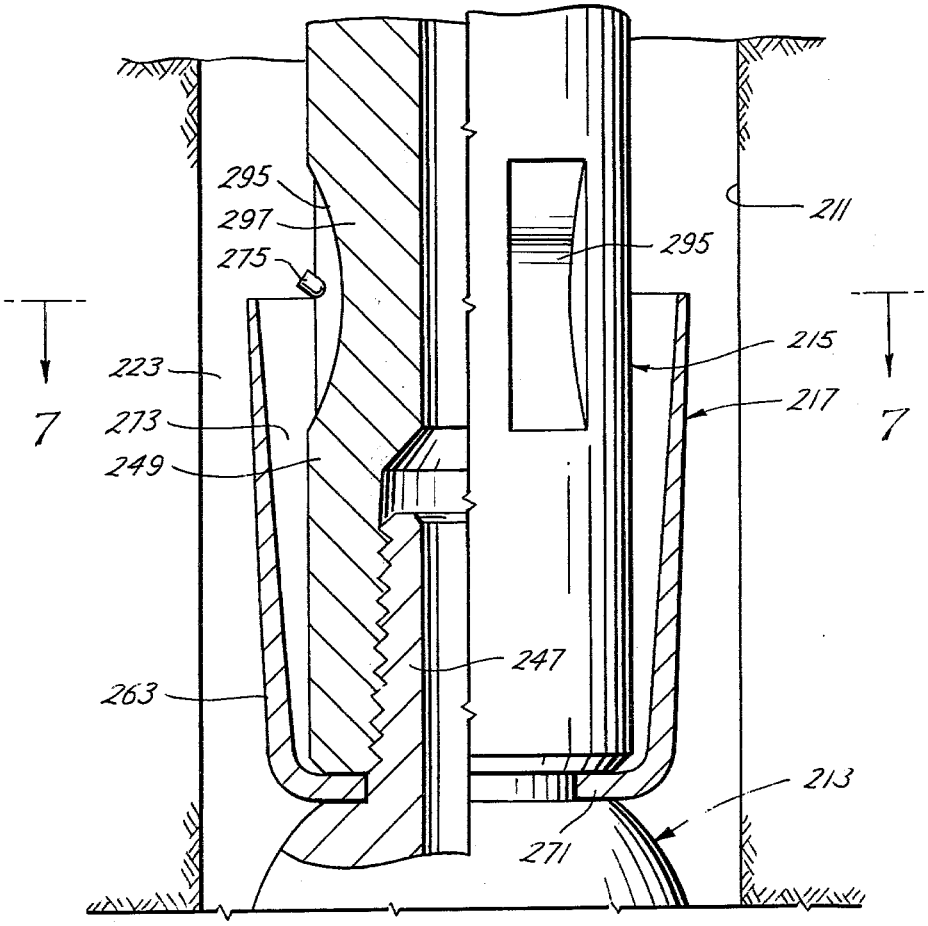

Referring now to FIGS. 6 and 7 there is shown a further modification of the FIG. 2 embodiment of the invention. In this embodiment parts similar to those of the FIG. 2 embodiment are given like numbers plus 200. Only the differences from the FIG. 2 construction will be described. The side 263 of the junk basket cup is of smaller inner diameter than in the FIG. 2 construction leaving a smaller annular pocket 273 between the side of the cup and the stabilizer neck 257. This leaves a larger external passage 223 for the upflow of junk. To accommodate larger pieces of junk in the basket, the neck 257 is arcuately fluted at 295. The flutes extend from above the rim of the cup to below the rim of the cup, but terminate above box 249. For this reason cup 263 is preferably deeper than in the FIG. 2 embodiment. Any number of flutes 295 can be provided, e.g. three, as shown in FIG. 7. The arcuate vertical cross-section of the grooves or flutes 295 prevents junk from being stuck therein. When the bit 213 is removed from stabilizer 215, junk falls out of the flutes as well as out of the bottom of basket 217. Preferably the flutes are equally spaced.

Figure 8:
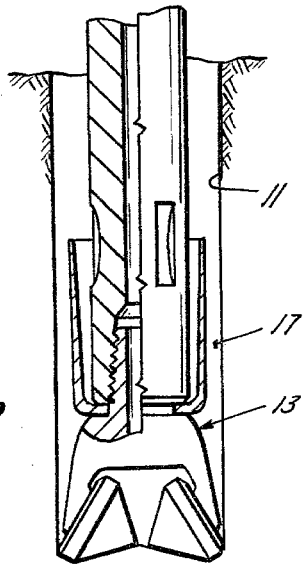
FIG. 8 is a view similar to FIG. 2 showing a further modification.

While a preferred embodiment of the invention and several modifications thereof have been shown and described, other modifications thereof can be made by one skilled in the art without departing from the spirit of the invention. For example, the lower drill stem member could be a stabilizer or, as shown in FIG. 8, a drill collar. As shown in FIG. 8, the outer periphery of the cup may be cylindrical, even though the inner periphery is upwardly flaring or conical.

I claim:

1. Subject matter, useful for earth boring comprising a junk basket cup, said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture, the rim of said cup having a sector spaced from the axis of said edge a greater distance than another sector thereof.

2. Subject matter useful for earth boring comprising a junk basket cup, said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture, the rim of said cup being circular but eccentric to the axis of the circular periphery of said edge, the side wall of said cup being displaced laterally from concentricity with said axis so as to connect said rim and said edge.

3. For use with a junk basket cup, e.g., said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture, a stabilizer comprising:

a generally tubular body, well bore engaging means carried by the body azimuthally spaced about the axis of the body, said body having a tubular neck at one end of smaller outer diameter than the body, a box connector at the end of said neck, said neck having a plurality of external vertical flutes azimuthally spaced apart about the body, said flutes extending from adjacent said box connector toward said body but terminating short of said body, said flutes providing passages along said neck through which junk can pass into such a cup when assembled with the stabilizer around the neck thereof.

4. Subject matter of claim 3, said flutes being arcuate in a section along the stabilizer axis.

5. For use with a junk basket cup e.g., said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture, a drill bit having a taper threaded pin whose thread pitch is from 4 to 5 threads per inch, and having a smooth cylindrical root extending from the crest of the largest turn of said thread to a plane shoulder around said root perpendicular to the thread axis, the height of said root being of the order of the axial extent of several turns of the thread.

6. Subject matter useful for earth boring comprising:

a junk basket cup, said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture, and a drill bit and a lower drill string member having correlative threaded pin and box connector means which together with said edge of the cup of the basket make a rotary shouldered connection, the pin being on the bit and having a tapered threaded portion extending from an unthreaded portion forming a root and having a shoulder thereabout, the end of said pin being axially separated from the bottom of the box, said root of the pin being in tension, said edge being in compression between said shoulder and the mouth of the box.

7. Subject matter of claim 6, said lower drill string member having a plurality of longitudinal grooves about its box extending from above to below the rim of the cup.

8. Subject matter of claim 6, the rim of the junk basket cup being unequally spaced from said box forming with said box at its larger spacing sector a junk receiving portion and opposite therefrom having its smaller spacing sector providing a sector for external upflow of junk between the cup and a bore hole.

9. For use with a junk basket cup, e.g., said cup having an apertured bottom and an upstanding side wall terminating in a rim, the inner periphery of said side wall flaring progressing in the direction from said bottom toward the rim of the side wall, said apertured bottom having but a single aperture therethrough and having an inner edge whose upper and lower surfaces are plane and parallel, the periphery of said edge being circular, said edge being made of material suitable for making a rotary shouldered connection between a drill bit and a lower drill string member used in the rotary system of drilling, i.e. a metal having a hardness in the range of 200–350 Brinell and a tensile strength of at least 80,000 pounds per square inch, said side wall being imperforate and said bottom being imperforate except for said single aperture.

a tubular lower drill string member having a fluted neck adjacent a threaded box at the end of said member, said neck having a generally cylindrical outer periphery of constant diameter smaller than the part of said member immediately adjacent thereto, each of said flutes extending parallel to the axis of said cylindrical outer periphery from adjacent to said box toward a location away from said box but terminating short of the end of said neck leaving a smooth cylindrical portion of said neck beyond said flutes at the ends thereof farthest from said box.

10. Subject matter of claim 9, said lower drill string member being a drill collar.

11. Subject matter useful for earth boring by the rotary method comprising:

a junk basket cup, said cup being made of steel having a hardness in the range of 200–350 Brinwell and a tensile strength in the range of 100,000 to 150,000 pounds per square inch, and including an upstanding side wall terminating in a rim and a circularly apertured bottom having an inner edge whose upper and lower surfaces are plane and parallel, said bottom and side wall being connected by an imperforate rounded portion whose inner and outer surfaces are quatrotoroidal, the inner and outer surfaces of said side wall being imperforate and flaring upwardly, said apertured bottom having but a single aperture therethrough, the cup being otherwise imperforate, whereby when said cup is positioned with the pin of a rotary drill bit extending through said aperture drilling fluid will be prevented from flowing up through the cup and will be wholly diverted to flow past said bottom and rounded portion and outside of said side wall up to said rim with the horizontal crosssection of the annulus flow space between the exterior of the cup and the earth bore therearound made by such bit decreasing progressing upwardly to increase the velocity of flow of drilling fluid from the bit flowing upwardly around the cup, until at said rim the crosssection of said flow space suddenly increases to reduce the velocity of such fluid and allow detritus carried upwardly from below the cup by such drilling fluid to fall back into said cup.

* * * * *

UNITED STATES PATENT AND TRADEMARK OFFICE

CERTIFICATE OF CORRECTION

PATENT NO. : 4,217,966

DATED : August 19, 1980

INVENTOR(S) : William R. Garrett

It is certified that error appears in the above—identified patent and that said Letters Patent is hereby corrected as shown below:

Col. 3, line 11, after "section" insert a comma (,).

Col. 1, line 10, change "tunsten" to -tungsten-.
Col. 9, line 13, change "Brinwell" to -Brinell-.
Col. 10, line 11, change "crosssection" to -cross section-.
Col. 10, line 16, change "crosssection" to - cross section-.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*